United States Patent [19]

Gebauer et al.

[11] 4,403,924

[45] Sep. 13, 1983

[54] METHOD AND DEVICE FOR REGULATING THE OUTPUT OF DIAPHRAGM PUMPS

[75] Inventors: Gerhard Gebauer, Bermatingen; Fritz Bachschmid, Friedrichshafen, both of Fed. Rep. of Germany

[73] Assignee: J. Wagner GmbH, Fed. Rep. of Germany

[21] Appl. No.: 157,273

[22] Filed: Jun. 6, 1980

[30] Foreign Application Priority Data

Jun. 8, 1979 [DE] Fed. Rep. of Germany ..... 2923284

[51] Int. Cl.[3] ..... F04B 43/00

[52] U.S. Cl. ..... 417/388

[58] Field of Search ..... 427/388, 385, 386, 387; 60/585, 587, 592

[56] References Cited

U.S. PATENT DOCUMENTS

Re. 29,055 11/1976 Wagner ..... 417/388
2,713,827 7/1955 Hoop ..... 417/388
3,367,270 2/1968 Schlosser ..... 417/388
4,022,381 5/1977 Karliner ..... 417/388

FOREIGN PATENT DOCUMENTS 1069107 7/1954 France .
1142642 2/1969 United Kingdom .

*Primary Examiner*—Leonard E. Smith
*Attorney, Agent, or Firm*—Hill, Van Santen, Steadman & Simpson

[57] ABSTRACT

A method and device for regulating diaphragm pumps during standby which reduces power input demands during non-delivery standby conditions while assuring a maintenance of working pressure upon a sudden change to a delivery condition which utilizes pressure of the drive fluid as a regulating variable by retaining a portion thereof outside of the drive chamber and using the pressure of the retained portion to control one or both of an intake aperture to the drive chamber or a pressure limiting outlet valve from the drive chamber.

9 Claims, 3 Drawing Figures

METHOD AND DEVICE FOR REGULATING THE OUTPUT OF DIAPHRAGM PUMPS

BACKGROUND OF THE INVENTION

1. Field of the Invention

This invention relates to diaphragm pumps, and more particularly to intermittently utilized continuous running diaphragm pumps of the type used in connection with spraying guns where the gun demand is intermittent while the drive force to the pump remains engaged.

2. Prior Art

Diaphragm spray pumps, particularly paint spray pumps, are known to the art and include devices which regulate the pumping system during standby state when the spray gun is closed but the driving motor is running. This invention relates to such pumps and to a method and device for regulating the output of diaphragm pumps used for delivering working substances, particularly liquids for airless spraying by means of high pressure spray guns. Such pumps generally comprise two chambers separated by a movable diaphragm. A first of the chambers is filled with a drive fluid which is alternately loaded and unloaded (pressurized and unpressurized) by an oscillating piston. A second chamber is designated as a driven fluid chamber or working substance chamber. Additionally, the pumps include a pressure limiting valve which discharges drive fluid from the drive chamber to a reservoir when the pressure in the drive chamber exceeds the setting of the limit valve. A closable intake aperture or restricted intake aperture is provided for supply of drive fluid from the reservoir to the drive chamber.

Such diaphragm pumps are distinguished from other pumps in that the driven fluid does not come into contact with the oscillating pump piston. This is particularly advantageous when the driven fluid, as often is the case, has a certain corrosiveness or abrasiveness. Difficulties, however, can arise from such uses when the delivery of the pumped fluid is frequently interrupted while the pump drive remains in operation during the interrupted (standby) state. A distinct example of such usage is the spraying of paints and lacquers by means of airless high pressure guns. During the painting operation, the gun is frequently opened and closed whereas, in contrast, the pump motor remains in constant operation. If the gun is closed, i.e. liquid is no longer being sprayed, then the pressure in the pumped fluid chamber increases to the point that the diaphragm can no longer arc into the pumped fluid chamber. The diaphragm is therefore brought to a standstill. In so doing, however, there exists the necessity of opening the pressure limit valve of the drive fluid chamber so that an excess amount of drive fluid corresponding to the displacement volume of the piston can be discharged from the drive chamber through the limiting valve to the reservoir. At the next successive suction stroke of the piston, absent other controls, that same amount of drive fluid will again be sucked into the intake aperture of the drive fluid chamber. In this type of construction, there thus ensues a continuous standby state circulation of driving fluid from the driving chamber through the pressure limit valve to the reservoir and thence from the reservoir through the intake aperture back to the drive chamber. The energy generated by the pump drive in such a standby state will be converted into a fluid circulation which in turn converts the energy to heat upon passing through the pressure limit valve. The end result is that the drive energy requirement is high during standby and a continuously high heat input to the drive fluid will occur.

In order to avoid excessive heating of the drive fluid during such standby operation, it has been known to provide special cooling apparatus. In such systems, a reduction of energy input during standby is not to be achieved. Another known method for avoiding overheating is through the utilization of a closable intake aperture from the reservoir into the driving fluid chamber. In such construction, a valve or an intake slot traversed by the piston can be used which has a smaller flow capacity than the pressure limit valve such that the amount of fluid discharged by the pressure limiting valve on the pressure stroke of the piston cannot be entirely replaced on a single suction stroke of the piston. As is known in the art (U.S. Pat. Nos. 3,254,845; 3,367,270) the reduction in full volume through the intake valve is such that an under pressure will arise in the driving fluid during the suction phase movement of the piston to the extent that a change in the nature of the drive fluid is said to occur. Independently the question of the nature of the change, one can still proceed from the fact that the circulation during the standby phase is in fact lower dependent upon how strongly the intake aperture is choked. At any rate, what is achieved with this choking method is that the driving fluid will be less heated during the standby phase and that the output power of the pump motor or drive will be reduced during standby.

Although the above method has advantages, it has a significant disadvantage. When the gun is reopened after standby operation, a considerable time period is required until the full amount of the drive fluid can be reintroduced through the reduced intake aperture to the drive chamber. The result of this is a pressure drop in the driven fluid chamber. This pressure incidence in the driven fluid chamber is increased the more strongly the intake aperture is choked. Thus, one will always have to strike a compromise between the degree of intake aperture restriction and the length and extent of pressure change upon reversion to a spraying status from a standby status.

Another previously disclosed method includes therein the mixing of a certain percentage of air into the drive fluid (U.S. Pat. Nos. 3,680,981; RE 29,055). The addition of air makes the driving fluid somewhat elastic. As a result of the compressibility of the air, it is not necessary in a standby phase to discharge from the drive fluid at every pressure stroke an amount which corresponds to the entire displacement volume of the piston so that the fluid circulation, and thus the heating and power output are reduced. The pressure change upon reopening of the gun is reduced or avoided by this method, however, here also, a compromise must be made where, given a small amount admixed air, the fluid circulation in the standby state is still considerable whereas, given too great an amount of admixed air, too great a power reduction will occur during the actual working phase of the pump. Experience has indicated that the air admixture method, in particular, or combination of the air admixture and driving fluid change methods gives satisfactory results when used in connection with diaphragm pumps of low or moderate output but that difficulties occur when diaphragm pumps of higher output are used. Moreover, particularly using high output diaphragm pumps, there is an added that changes from small to large spray nozzles have an effect which is analogous to the extreme case of the change from a closed to an open gun.

It would therefore be a distinct advance in the art of intermittent demand continuous drive diaphragm pumps to provide a device and method of operation which reduces or eliminates many of the difficulties heretofor encountered.

SUMMARY OF THE INVENTION

The principal object of this invention is therefore to provide a method and device for regulating the output of diaphragm pumps of the type described above which, on one hand, provides a desired power output of the pump drive adapted to the respective demands while preventing an excessive heating of the driving fluid even in the case of high powered diaphragm pumps and which, on the other hand, assures that the desired working pressure is always available in the driven fluid chamber even upon a sudden change from a standby state to a working state (closed gun to open gun).

This principal object is achieved by maintaining a part of the varying pressure drive fluid outside of the drive chamber and utilizing the dynamic pressure of that fluid as a steady signal for regulating the flow clearance of the outlet valve from the driving fluid side and/or of the intake aperture flow.

In this method, the pressure of the driving fluid is employed as a regulating variable which, in order to obtain a steady signal, has a portion thereof subjected to retention outside of the drive chamber. The pressure (dynamic pressure) of the retention portion is then used to control the intake aperture, the pressure release valve or both the intake aperture and the pressure release valve in such a manner that the desired relationship to the respective operating state (standby or working phase) is experienced. In this manner, it is possible to both avoid heating of the drive fluid during the standby state while immediately obtaining the desired operating pressure upon change over from standby to working states.

In a first embodiment, regulation of the intake aperture of the drive chamber can be done by utilizing drive fluid from the pressure limiting valve which is used to control food supply to the intake aperture of the drive chamber as a function of the dynamic pressure in such a manner that the supply to the intake aperture will be throttled with increasing dynamic pressure of the fluid from the pressure limiting valve and will be increased with decreasing dynamic pressure. In such a method the supply of drive fluid flowing from the reservoir to the drive chamber can be regulated in relationship to the dynamic pressure which derives from damming up the drive fluid which is pulsatingly emitted from the pressure release valve. If the pressure release valve suddenly emits a significantly greater quantity of drive fluid, which is the case when the spray gun is closed, then the supply of drive fluid to the drive chamber will be choked. When this occurs, the amount of drive fluid discharged by the pressure limiting valve will not be fully replaced via the intake aperture and therefore only very limited circulation of drive fluid out of the drive chamber and back into it will occur. Thus, in this condition, the amount of fluid situated in the drive chamber is reduced, the power requirement is diminished and heating of the drive fluid is kept within limits. However, if the gun is thereafter opened, no additional quantity of drive fluid will pass through the pressure release valve and the dynamic pressure downstream of the pressure release valve will quickly decrease such that the feed to the intake aperture of the drive chamber will be fully restored and the drive fluid can thus freely flow back to the drive chamber in such a quantity that given the next successive suction stroke, the amount of drive fluid required for maintenance of working pressure will be returned to the drive chamber. In this manner, a pressure drop within the driven fluid chamber will not occur and the spray gun will immediately function with full spray pressure.

In a further modification of this concept, an inertia or delay can be added to the regulation system such that the regulation of the feed to the intake aperture of the driving fluid chamber will occur only after a time delay. The time delay promotes stabilization of the feed regulation and represents a significant feature of the invention. However, at at least one specific point in time, namely upon reopening of the gun after a standby phase, such an inertia or delay in the regulation can be disadvantageous and, in extreme cases, may even lead to the undesired pressure drop. For this reason, this invention proceeds such that given a rapid decrease in the dynamic pressure, the device can function without the inertia and thus without the time delay.

In one physical embodiment, the time delay or inertia can be provided for by utilizing a sliding valve or needle valve assembly which is inserted into the fluid line from the reservoir to the drive fluid chamber intake aperture coupled with a restriction inserted in the fluid line between the pressure limiting valve and the reservoir with a branch line upstream of the restriction to the slide valve.

In a further modification of this construction, the branch line can be communicated to the back side of the slide valve through an additional restriction with, however, a spring back check valve allowing rapid flow away from the back side of the slide valve. In this construction, upon reopening of the spray gun, full fluid flow to the inlet aperture to the driving fluid side of the diaphragm will rapidly occur since the check valve at the back side of the slide will quickly open as soon as there is a pressure drop in the line from the pressure release valve to the reservoir with the resultant release of the pressure tending to close the slide valve.

In a further modification of the invention, rather than controlling the flow to the intake aperture to the driving fluid side of the diaphragm chamber, regulation can occur by allowing a total opening of the pressure release valve. In this method circulation of drive fluid from the drive chamber through the pressure release valve to the reservoir and thence back to the intake aperture to the drive chamber is not interrupted or choked in the standby phase, but, on the contrary, is allowed a continuous recirculation according to the displacement volume of the drive piston. Nonetheless, no heating of the drive fluid will thereby occur because the circulating drive fluid is not under pressure, the pressure release valve being held in a full open position and the intake aperture being adequately sized to allow easy recirculation. In this construction, the pressure relief valve can be maintained open by utilizing the dynamic pressure of a stored portion of the displaced driving fluid.

In one embodiment shown, the pressure relief valve may be in the nature of a slide spool valve which in one position communicates directly the driving fluid chamber to the reservoir, while in another position blocking that communication. Activation of the slide valve to the first position is accomplished by passing high pressure driving fluid past a check valve to a chamber at one end of a slide spool valve. Thereafter, by utilizing a diaphragm controlled valve, a pressure release line to the back side of the slide spool valve can be opened as soon as a pressure drop occurs on the pumped fluid side of the diaphragm.

A further method of controlling pressure forces during standby can be based upon varying the piston drive. Particularly if a slidable pressure limit valve is utilized as a regulating piston coupled to a swash plate drive for the driving piston, then it is possible to diminish or reduce to zero, the stroke of the driving fluid drive piston during standby with the result that the drive fluid will not be pressured at all during the standby stage.

It is therefore a principal object of this invention to provide an improved self-regulating diaphragm pump.

It is a more specific object of this invention to provide a self-regulating diaphragm pump which has a reduced drive demand during standby state and a self-regulating system for controlling reduction of the drive demand by means of valve control either of the driving fluid replenishment or intake passaging or of the pressure release valve outlet passaging.

It is another, and more specific object of this invention to provide self-regulation of a diaphragm pump during standby by utilizing the pressure of a portion of the drive fluid to provide a valve regulator pressure for controlling either the drive fluid intake or the pressure limiting valve for the drive fluid chamber, the portion being segregated from the driving fluid flow.

Other objects, feature and advantages of the invention will be readily apparent from the following description of preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

In the accompanying figures, and the following explanation, reference will be made primarily to those features of diaphragm pumps necessary for those skilled in the art to understand the invention hereinafter claimed. For further discussion of diaphragm pumps particularly adapted for use in intermittent spraying operations, reference can be had to U.S. Pat. Nos. 3,254,845 and 3,367,270 to Schlosser; U.S. Pat. Nos. RE 29,055, 3,657,933 and 3,623,661 to Wagner, the teachings of which are incorporated by reference herein.

Figure 1:
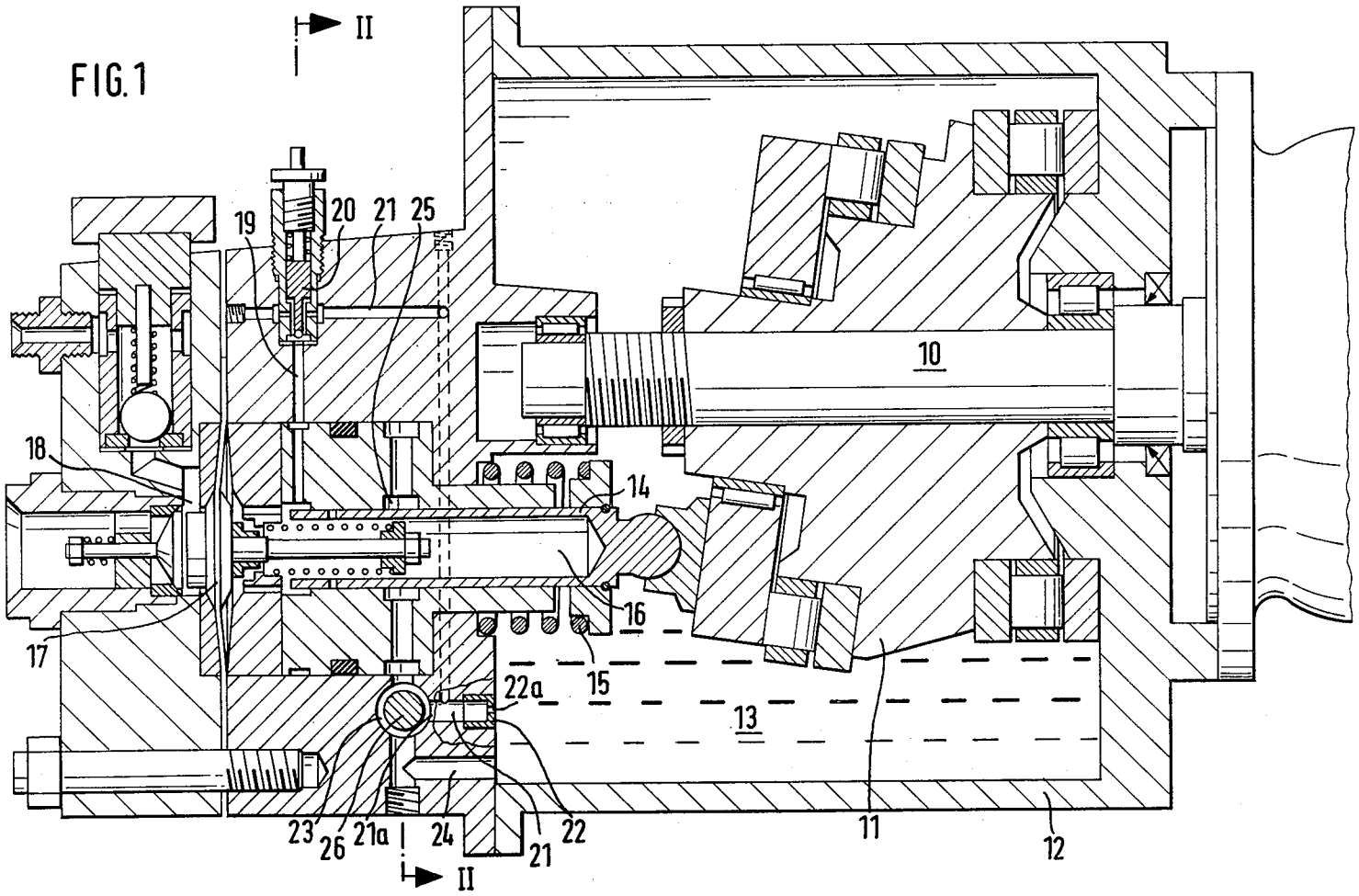
FIG. 1 is a fragmentary cross-sectional view of a diaphragm pump according to this invention.

As shown in FIG. 1, a swash plate 11 is affixed to a drive shaft 10 of a prime mover such as an electric motor (not illustrated). The swash plate 11 is rotated within a reservoir defined by housing 12, and is partially submerged in a drive fluid such as oil 13. The swash plate 11 drives an oscillating piston 14 which is provided with a return spring 15. A cylindrical drive chamber 16 is defined at the one end by the face of piston 14, and at the other end by diaphragm 17. On that side of the diaphragm 17 facing away from the drive chamber 16, there is a delivery chamber 18 for the working substance or driven fluid to be supplied to a driven fluid utilization device. For example, the driven fluid can be a coloring substance for feeding the high pressure spray gun (not illustrated). On the driven fluid driving chamber 18 side of the diaphragm 19 there are provided normal intake and outlet valves connected respectively to the driven fluid source and to the spray gun. The diaphragm 17 may be seated in a standard manner such that it will only arc into one side during operation, i.e. into the chamber 18.

The drive chamber 16 is connected via passageway 19 to the intake side of a pressure limit valve 20. The outlet from the valve 20 is through passageway 21 to the reservoir defined by housing 12. A restriction 22 having a relatively small aperture **22*a* therethrough is inserted in the end of passageway 21 at the reservoir 12. In addition, passageway 21 has a branch passage 21*a* branching off from passageway 21 upstream of the restriction 22. Passageway 21*a* discharges to a bore 23. Passageway 24 traversing bore 23 communicates in intake slot 25 to the drive chamber to the reservoir 12. Suitable passaging in the piston 14 communicates the intake slot 25 to the drive chamber 16 at one extreme withdrawn position of piston 14**.

Figure 2:
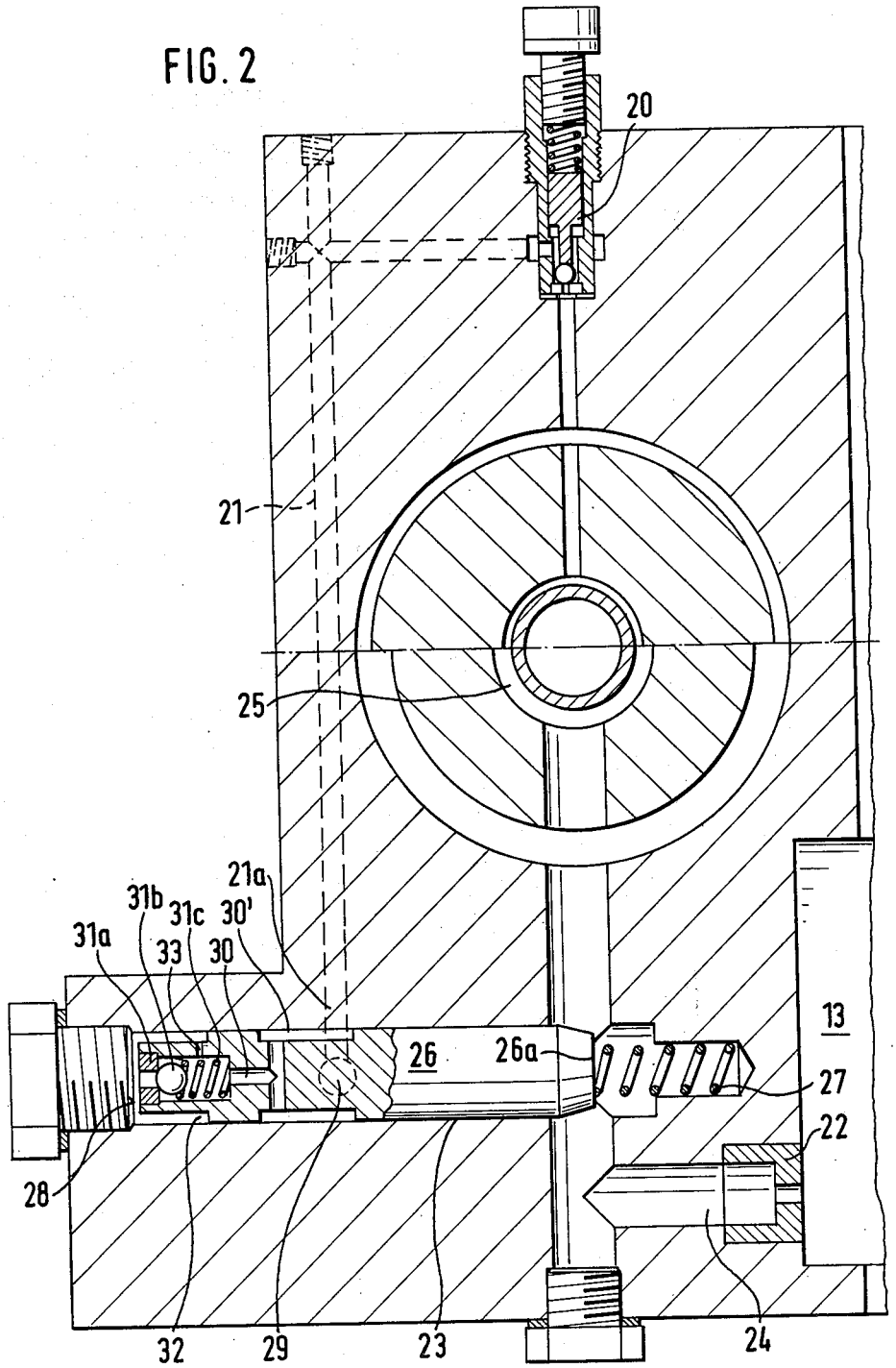
FIG. 2 is a cross-sectional view of the pump of FIG. 1 taken along the lines A-B of FIG. 1, FIG. 2 being shown on a large scale.

As best shown in FIG. 2, a slide valve or needle valve 26 having a control face **26*a* is slidable in the bore 23 and can reduce or close passage of drive fluid through the line 25 to the intake slot 25. Valve 26 is loaded by spring 27 to an open position as illustrated in FIG. 2 in which position it is displaced towards the left and towards a rear wall stop 28 of the bore 23. In this fashion the control edge 26*a* fully opens the path of passageway 24 through the bore 23 thence to the slot 25**.

Slide valve 26 also has a cross bore 29 approximately midway along the length of the valve 26. Cross bore 29 discharges at both ends to an annular groove 30'. Branch line **21*a* discharges the bore 23 in the area of the groove 30'. An internal axial bore 30 extends from the cross bore 29 towards the back of valve 26. A spring back check valve 31 consisting of valve seat 31*a*, valve ball 31*b* and valve spring 31*c*, blocks the axial bore 30. Upon lifting of ball 31*b*, passageway 30 communicates directly through to the back side of valve 26. A further annular groove 32 around the back portion of the valve 26 is open to bore 30 via a small opening passageway 33. Groove 32 is also open to the back side of the valve 26**.

In order to understand the functioning of this device, the fundamental principals will first be described without referring to the restriction 22 and valve 26. In other words, the function will first be described as passageway 21 from the pressure valve 20 discharged directly and without restriction into the reservoir and line 24 led directly and unrestricted from the reservoir 12 to the intake slot 25.

When the prime power source, such as an electric motor, is placed in operation, swash plate 11 will displace the piston towards the left (pressure stroke). Piston 14 in turn will displace oil 13 located within the drive chamber 16 against the diaphragm 17. This will cause diaphragm 17 to arc into the delivery chamber 18 and thereby exert pressure on the driven fluids positioned therein. Due to influence of spring 15, the piston 14 will return to its idle position toward the right (suction stroke) as the swash plate continues rotation. During this return of the piston, the diaphragm 17 will also return to the right whereby the drive fluid 13 located in the chamber 16 will be displaced towards the right of FIG. 1. Due to the back and forth motion of the piston 14, the diaphragm 17 is continuously moved back and forth, in the embodiment illustrated between a plane parallel position and an arched position. In this manner, the oil 13 situated in the drive chamber 16 serves only as a hydraulic transmission system between the piston and the diaphragm. Assuming that the driven fluid is continuously discharged from chamber 18, then a stable state will occur after a short period of time. That is if the spray gun is open, a state will occur in which the driven fluid is under a constant pressure, for example, 200 bar, and where the oil in the chamber 16 is slowly pushed back and forth by the piston 14 without having the pressure limit valve open. In such an example, of course, the pressure limit valve will be set to a release point, for example, 230 bar, greater than the pressure of the driven fluid. In this operation, the intake slot 25 which is traversed by the oscillating piston and is only open to the drive chamber at the extreme right hand dead-center position of the piston will not be subject to fluid flow.

Now, however, if the discharge of driven fluid from chamber 18 is suddenly interrupted, for example, by closing of the gun, then the fluid pressure in the delivery chamber 18 will increase. At this point the diaphragm 17 will no longer be capable of arching into the chamber 18, and the driving fluid or oil situated in the drive chamber 16 will be subjected to an over pressure on the driving stroke of the piston. In this instance, pressure limit valve 20 will open and a part of the oil within the driving chamber will pass the pressure limit valve and flow via passageways 19 and 21 into the reservoir 12. On the next successive return motion of the piston (suction stroke) an under pressure will be created in the driving chamber 16 as a result of the reduced oil amount contained therein, closure of the pressure valve 20 preventing any back flow via passageway 19. Upon the piston 14 reaching the dead-center extreme right hand position, oil will therefore be sucked into driving chamber 16 from the reservoir 12 through passageway 24 and intake slot 25. On the next pressure stroke of the piston, however, the replenished amount of driving fluid will again be discharged from the chamber 16 through the pressure release valve 20. In this construction there will arise a continual oil recirculation from the chamber 16 through passageways 19, 21 to reservoir 12 and from the reservoir 12 through passageway 24 intake slot 25 back to chamber 16. If one assumes that the diaphragm 17 is retained in its idle position due to the increased pressure in the driven fluid chamber 18, then the amount of oil circulated will correspond to the displacement volume of the piston 14. When the gun is reopened, pressure in the driven fluid chamber 18 will drop, the diaphragm 17 will be able to arc into the chamber and the pressure limit valve 20 will close. At this time oil circulation will be interrupted and the pump will again function in the steady state manner initially described.

The above described operation is known to the prior art where the discharge passageway 21 of the pressure limit valve 20 leads directly and unrestricted to the reservoir 12 and the passageway 24 from the reservoir 12 to the intake slot is also unrestricted. Of course, the above description has been simplified for reasons of clarity and does not correspond to all practical conditions. Namely, insofar as practice is concerned, the diaphragm 17 is not suddenly brought from the idle position to its full stroke nor, respectively, is it suddenly brought from the oscillating motion to the idle position. Moreover, the desired working pressure in the driven fluid chamber 18 does not achieve a constant variable for the very reason that, among others, spray nozzles of different size are usually employed. These conditions, in practice, however, lead to the fact that a quantity of oil recirculation occurs even when the gun is open although such open gun recirculation is limited in comparison to oil circulation during standby.

This type of prior art operation is not desired in that the energy demands during standby for recirculation of the oil are relatively great and the oil is subjected to much working and heating.

Referring now to the specific embodiment of the invention shown in FIGS. 1 and 2, operation of the inventive device is hereafter described. When delivery of the driven fluid out of chamber 18 is interrupted, for example, by closing the spray gun, then pressure will rise in the driven fluid chamber 18. Increased pressure in the driven fluid chamber 18 will also result in an increase in driving fluid chamber 16. Thus, movement of the piston 14 will displace a considerable amount of driving fluid out of the chamber 16 via passageway 19 and the pressure limit valve 20. This amount of oil, however, cannot imediately flow off through passageway 21 to reservoir 12. Due to the restriction 22 in passageway 21, a portion of the discharge driving fluid will pass by branch passageway 21 to the annular groove 30'. That fluid will then pass through the cross bore 29 and the axial bore 30 of the valve 26. This quantity of discharged oil will then flow to the back side of valve 26 via outlet 33 and the annular groove 32. However, as can be seen from reference to FIG. 2, the dynamic effect of the pressure of the driving fluid on the valve 26 is not equally balanced. On the contrary, the dynamic pressure effect is towards the right with the result that valve 26 will be dislaced towards the right against the force of spring 27. This displacement will thereby throttle or respectively, block oil feed through passageway 24 to the intake slot 25. Thus, the control edge **26*a* of valve 26 will regulate flow of oil from the reservoir 12 to the intake slot 25. The result of this is that the same amount of driving fluid oil can no longer be returned to the chamber 16 as was ejected through the pressure limit valve 20. In this manner, on the next pressure stroke of the piston 14, the same quantity of oil discharged through the pressure limit valve 20 on the prior pressure stroke will no longer be ejected through the pressure valve 20. The result of this, however, is that the dynamic pressure of the trapped fluid will slowly decrease and the slide valve 26 will somewhat reopen the oil intake passageways. The displacement of the valve 26 toward the left, however, is opposed by the oil cushion that is formed between the back of the vavle 26 and the wall 28 of the bore 23 which can only be very slowly bled off via aperture 33. In this manner, an inertia is provided which does not respond to the individual pulses of the oil ejected through the pressure release valve 20. Such pulsations, in practice, occur approximately 25 times a second. Thus, the valve 26 will very quickly close passageway 24 but, however, due to the oil cushion, will only slowly follow the steady control variable. In this manner stable operating state will arise such that the supply of oil to the chamber 16** during standy phase (closed gun) is greatly throttled but not completely interrupted. In this manner, a certain limited oil circulation will occur during standby. However, the limited oil circulation is very small in comparison to the above described full recirculation and, in fact, is hardly any larger than is normally encountered during operation of the pump with the gun open. At any rate, excessive heating of the oil is now eliminated.

When the spray gun is reopened, pressure in the driven fluid on the driven fluid chamber side 18 of the diaphragm will decrease relatively quickly. Due to the quick decrease of the pressure in the driven fluid chamber 18, pressure in the driving fluid chamber 16 will also quickly drop. At this time, valve 20 will be closed and no driving fluid will be directed to passageway 21. By so limiting flow to passageway 21, however, the dynamic pressure in passageway 21 and in the cross bore 29 will also drastically decrease so considerably that the slide 26 will move toward the left and the oil cushion situated in the annular groove 32 as well as behind the back of valve 26 will be sufficiently great to lift ball valve 31*b* from seat 31*c*. This allows the oil entrapped behind valve 26 to be quickly bled off to the cross off to the cross bore 29 and into passageway 21 by a relatively large passageway in comparison to bore 33. Thus, spring 27 will be able to return valve 26 quickly to the left to its idle position due to the absence of the dampening effect of the oil cushion. In other words, the throttling or restriction of passageway 24 will be quickly withdrawn and at the next suction stroke of the piston 14, the entire amount of driving fluid required to replenish the driving fluid chamber 16 will flow through passageway 24 and slot 25.

This quick withdrawl of the restriction of the intake flow from the reservoir to the driving chamber means that the pressure drops heretofore encountered upon quick reopening of the spray gun will not occur here. Of course, the operations described do not occur only in the extreme case of the closure or respectively opening of the spray gun, but rather, to a reduced degree even when change is made from a small to a large spray nozzle. In any case an essentially constant oil circulation occurs during all operating phases, whether standstill phase or working phase. This constant oil recirculation, however, is of very limited amount such that no injurious heating of the driving fluid will occur. Thus, both operating and standby phases will economically operate, however, even given the extreme change from closed gun to open gun no substantial pressure drop will occur but, contrary thereto, delivery pressure will simply slowly decrease from the maximum pressure of standby state to normal working pressure.

Of course, the embodiment herein described can be subject to numerous variations, however what is significant is the fact that it is not a pulsed signal which is employed as the control variable for delivery of the drive fluid to the drive chamber, but rather, a substantially steady signal. The steady signal is generated by the dynamic pressure of the driving fluid discharged by the pressure limiting valve which is utilized exterior of the driving fluid chamber and the reservoir. Moreover, it is important that the system is damped or throttled in such a manner that a stable throttled state can occur. Finally, as explained, measures are taken to provide a neutralization of the throttled state which is very quick acting and relatively inertia free.

Figure 3:
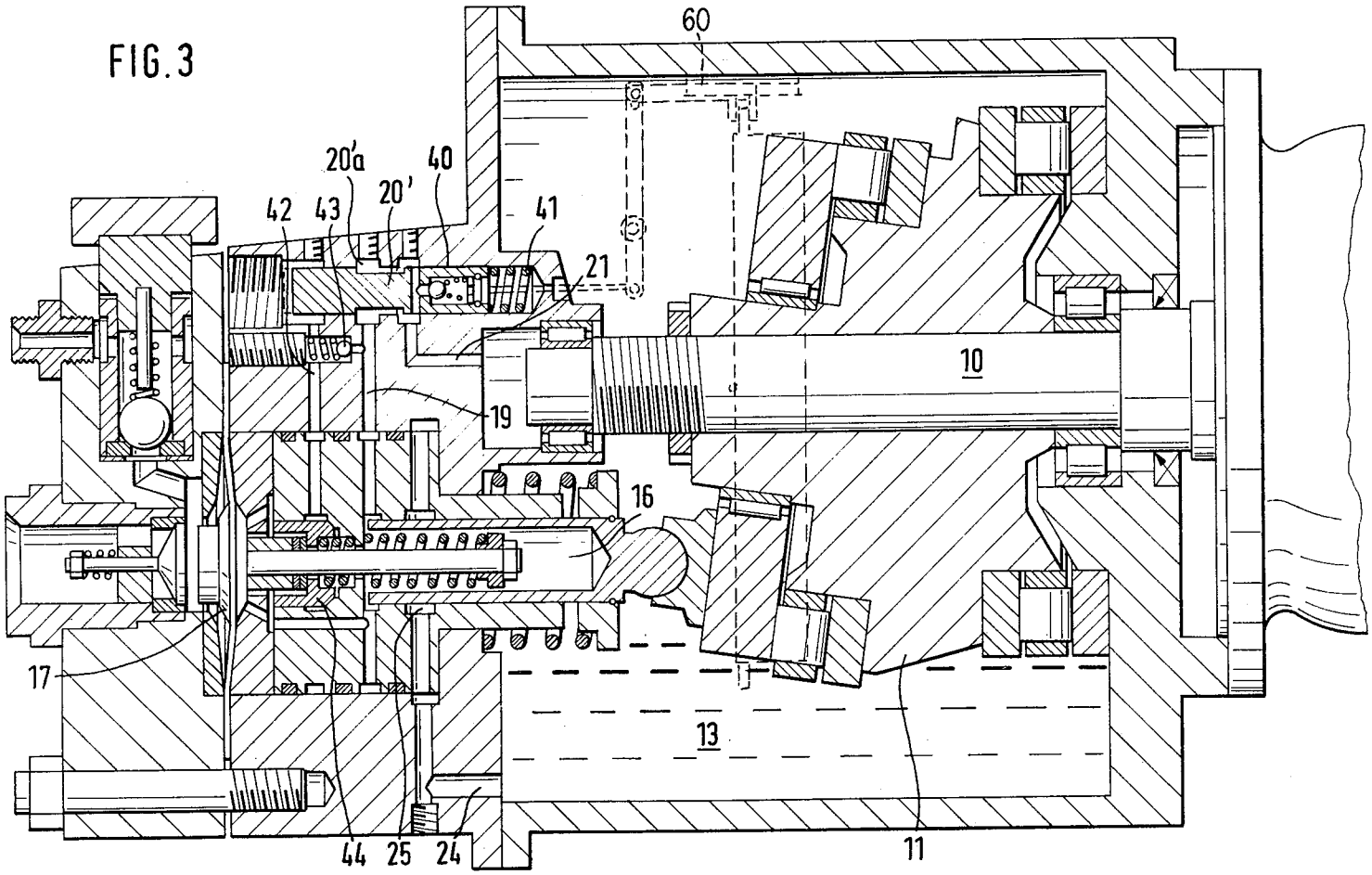
FIG. 3 is a view similar to FIG. 1 showing a modified embodiment of the invention.

A second embodiment is illustrated in FIG. 3. The basic construction of the diaphragm pump of FIG. 3 corresponds to that shown in FIG. 1 and identical parts are provided with identical reference numbers.

In the embodiment shown in FIG. 3 the intake slot 25 is relatively large and is directly connected to the reservoir 12. In this manner, driving fluid can flow unimpeded from the reservoir 12 through the passageway 24 to the intake slot 25 whenever an under pressure occurs in the driving fluid chamber 16. The pressure limiting valve 20 is constructed considerably differently than the previously described embodiment of FIG. 1. The pressure limiting valve 20 is constructed as a regulating piston which is slidable in a cylindrical housing bore 40 closed at both ends. Regulating piston 20' is loaded by a coil spring 41 and towards the left as shown in the figure. Intermediate the ends of the piston 20', an annular circumferential diameter grooved 20'*a* is provided. When the regulating piston 25 is properly positioned within the bore 40, the groove 20'*a* communicates a discharge line 19 from the driving fluid chamber 16 to a line 21 leading to the reservoir 12. In this manner, the piston 20' acts as a spool valve.

Passageway 42 is connected to passageway 19 through check valve 43 and also to the driving fluid chamber 16 via valve 44 and passageway 42. Passageway terminates on the left hand end of piston 25 so that pressure drive fluid in the chamber formed at the left hand end of regulating piston 20' will counteract the spring 41 to align passageways 19 and 21 with the annular groove 20'*a*.

Valve 44 is constructed as a seat valve and is connected to diaphragm 17 such that when diaphragm 17 is in its idle or rightmost position, valve 44 is closed blocking communication between the driving fluid chamber and passageway 42.

A device constructed in accordance with FIG. 3 will function as follows. During pumping phase driving fluid entering passageway 19 passing check valve 43 will pass via the upper portion of passageway 42 to the left hand end of regulating piston 20 at each pressure stroke. However, the diaphragm 17 will simultaneously open valve 44 such the fact that the pressure in line 42 and in front of the end face of the piston 20' will always equal the pressure in the drive chamber 16. In this event, the regulating piston 20' remains in its position to the far left caused by spring 41. In this position, annular groove 20'*a* is not aligned to provide a connection between passageways 19 and 21. Thus, the pressure limiting valve will remain closed.

However, upon a change from the working phase to the standby state (closing of spray gun) then the pressure in the drive chamber 16 will increase and the diaphragm 17 will move to its idle position closing valve 44. When this occurs pressure from passageway 19 will pass check valve 43 and will build in the chamber behind the left hand end of the regulating piston 25. This will counteract the spring force 41 causing the regulating piston 20' to shift to the right thus communicating passageways 19 and 21. Because valve 44 is closed and because valve 43 is a spring biased check valve, the pressure within the chamber at the left hand end of regulating piston 20' will be maintained sufficient to bias the regulating piston rightward against the spring. Thus, the high pressure in the line 42, which cannot escape past valve 44 or past valve 43 will maintain the pressure limiting valve 20' in its fully opened position. This condition is maintained during the entire standby phase such that an amount of driving fluid corresponding to the displacement volume of the drive piston will be discharged at every pressure stroke of the piston through the lines 19 and 21 to the reservoir 12. On the next successive suction stroke an equal quantity of oil will be reintroduced to the chamber 16 from the reservoir 12 through passageway 24 and intake slot 25. Although there is a total recirculation of the driving fluid or oil, heating of the oil will not occur because there is no resistance to the flow. This is assured by maintaining the passageways relatively large.

As pointed out, the pressure limiting valve 20' is not kept open by the circulating driving fluid and therefore that fluid does not have to be kept at any pressure. On the contrary, the amount of driving fluid which has been set aside within the chambers formed by passageway 42 and the chamber of valve 43 and the chamber to the left hand side of regulating piston 20*a* is maintained at a static pressure determined by the dynamic pressure of the driving fluid which was originally ported past valve 43.

Upon termination of standby status, for example, when the spray gun is opened, driven fluid pressure in the driven fluid chamber on the left of diaphragm 17 will reduce allowing diaphragm 17 to move to the left. This immediately unseats valve 44. Immediately upon unseating of valve 44, passageway 42 will again be connected to the drive chamber 16. Thus, the pressure in the line 42 will immediately drop and spring 41 will displace the regulating piston 20' to the left. This closes the pressure limiting valve—regulating piston 20'. At the next successive suction stroke the entire under pressure amount of driving fluid will be redrawn through the large intake slot 25 so that the full working pressure within the pump is substantially immediately available.

Of course, the spring 41 can be dimensioned in such a manner that the pressure limiting valve is completely closed only in those instances where a spray nozzle of maximum size at the spray gun is utilized and, on the other hand, will be slightly open allowing a limited amount of driving fluid recirculation when using smaller spray nozzles.

Although the oil circulation during standby phase in the embodiment of FIG. 3 does not result in any heating of the driving fluid—oil and also reduces power consumption during standby, there can nonetheless be cases in which such oil circulation is undesirable. If, when in the sample embodiment illustrated, the drive piston 14 is driven by means of a swash plate 11 whose attack angle determines the stroke length of the piston 14, then circulation in the standby phase can be completely suppressed by a coupling of the regulating piston 20' to a standard adjustment device for modifying the attack angle of the wash plate. In such a modification, when the regulating piston 20' is displaced towards the right it can act through a linkage 60 to cause the attack angle of the swash plate 11 to approach zero. This movement of the swash plate attack angle results in the fact that the stroke of the drive piston 14 will also approach zero. In this position oil displacement will no longer occur.

The only further proviso is that upon the return of the regulating piston 20' to the left, the swash plate 11 will again regain its original working attack angle without a time delay so that the desired working pressure within the driving fluid chamber and the driven fluid chamber will immediately be available.

It will be readily appreciated by those skilled in the art that various linkages and connections, either direct mechanical, hydraulic or electric, can be utilized to convert the rightward movement of the piston valve 20' to a change in the attack angle of the swash plate, the broken lines of FIG. 3 being incorporated to show merely schematically how such change can be effected.

Moreover, it will be readily apparent to those skilled in the art that if the drive piston 14 is driven by means of an eccentric, such as an eccentric bearing rather than by means of a swash plate, that the regulating piston 20' can then be used to adjust the eccentricity in an analogous manner.

Finally, it is also possible to provide the regulating piston 20' with a damping device effective in only one direction such that the end of the regulating piston 20' which faces the reservoir 12 is provided with a damping means, for example, the damping means shown in connection with valve 26 of FIG. 2.

It can therfore be seen from the above that this invention provides new and improved methods and devices for regulating diaphragm pumps subject to intermittent delivery requirements and specifically utilizes the pressure of a blocked off portion of the driving fluid ejected from the driving fluid chamber to control either flow of driving fluid from the driving fluid chamber freely or supply of driving fluid to the driving fluid chamber or both.

It will be appreciated that in the embodiments shown herein, as the piston is displaced to the left on the pressure stroke, when the diaphragm is prevented from full movement due to inability of the driven fluid to pass to the spray gun or other driven fluid utilization device, excess pressure will build in the driving fluid chamber. That excess pressure will be created only during driving strokes of the piston and therefore the pressure of the driving fluid which is herein used as the regulating signal, will normally be a highly amplitude varied pressure. However, according to this invention, by taking a portion of that driving fluid, which would otherwise be totally ejected back to the reservoir, and entrapping it in a closed chamber, either the chamber to the left end of piston 25 or the chamber to the left end of piston 26, the amplitude variation will be damped due to the trapped character of the driving fluid. This will result in a signal which is comparison to the amplitude variations of the driving fluid in the driving fluid chamber, is a steady signal. That reduced amplitude pressure, herein referred to as the dynamic pressure, can then be utilized to cause shifting of a control member. In the first embodiment illustrated, the control member is a needle valve which can close the intake passageway from the reservoir to the driving fluid chamber. In the second embodiment the control member is a slidable piston or spool valve which can allow free, relatively unobstructed communication from the driving fluid chamber back to the reservoir. In the third embodiment discussed and described by the broken line linkage system of FIG. 3, the control member is a slidable piston which actuates a linkage to change the attack position of the swash plate. Of course, other control members may also be contemplated. For example, when the intake to the drive fluid chamber is formed as a slide valve coupled to or including the driving piston, that slide valve may be movement controlled in response to the steady signal generated by the chambered or trapped portion of the otherwise ejected driving fluid. Other variations of this invention may be contemplated by those skilled in the art.

Although the teachings of our invention have herein been discussed with reference to specific theories and embodiments, it is to be understood that these are by way of illustration only and that others may wish to utilize my invention in different designs or applications.

We claim as our Invention:

1. A method for regulating the output of a diaphragm pump for delivering driven fluids, (particularly fluids for air-less spraying by means of high pressure spray guns), the pump comprising two chambers separated by a movable diaphragm, one of said chambers being a drive chamber filled with a drive fluid alternately loaded and unloaded by an oscillating piston and the second of said chambers a driven fluid chamber, the pump further including a pressure limiting valve from which drive fluid is discharged in pulsating flow from the drive chamber into a reservoir, and a closable intake aperture passageway for supplying drive fluid from the reservoir into the drive chamber, the method comprising the steps of: retaining a part of the drive fluid outside the drive chamber and reservoir, providing a restriction between the pressure limiting valve and the reservoir for dampening the pressure variations of said drive fluid, and using the dynamic pressure thereof to provide a pressure signal regulating the flow clearance of the intake aperture by controlling a throttleable valve in the intake aperture passageway whereby the intake aperture passageway is reduced in flow capacity with increasing signal pressure and is increased in flow capacity with decreasing signal pressure.

2. A method according to claim 1 wherein change in flow capacity of the intake aperture in response to change in flow of driving fluid emitted from the pressure limiting valve is time delayed in instances of slow changes in the amount of drive fluid emitted from the pressure limiting valve, the time delay being reduced when a large decrease in the amount of driving fluid passing the pressure release valve occurs.

3. In a diaphragm pump adapted to supply driven fluid in a system having for intermittent driving fluid demand, the pump having a chamber divided by a diaphragm member into a driven fluid chamber and a driving fluid chamber, a reciprocal piston received in a bore open to the driving fluid chamber for alternately loading and unloading driving fluid in the driving fluid chamber, a driving fluid release valve member releasably blocking an outlet passageway between the driving fluid chamber and a driving fluid reservoir exterior of the chamber, an inlet passageway communicating the driving fluid chamber to the driving fluid reservoir and a regulating system for controlling driving fluid flow during standby operation during periods of no demand for driven fluid, the improvement of the regulating system including: means for controlling flow of driving fluid between the driving fluid chamber and the reservoir to reduce power consumption substantially throughout standby phase operation, the means for controlling flow being responsive to pressure of a first portion of a driving fluid ejected from the driving fluid chamber, means disposed between the driving fluid release valve member and the reservoir for diverting at least a portion of the first portion of the driving fluid from the outlet passageway, a throttleable valve disposed in the intake passageway, a valve actuating chamber, a means for porting the diverted portion of the first portion of the driving fluid to the valve actuating chamber, the valve actuating chamber communicating with at least portions of the throttleable valve such that the presence of pressure fluid in the valve actuating chamber can cause movement of the throttleable valve for controlling flow through the inlet passageway.

4. The device of claim 1 wherein the means diverting includes a flow restricter in the first passageway.

5. The device of claim 4 including means venting the valve actuating chamber, the means venting being actuatable in dependent response to resumption of driven fluid demand.

6. A device for standby state regulation of constant drive input driaphragm pumps having two chambers separated by a movable diaphagm, one of said chambers filled with a driving fluid alternately loaded and unloaded by an oscillating piston, the other of said chambers being a driven fluid chamber, a pressure limiting valve for controlling discharge of driving fluid from the driving fluid chamber through a passageway to a reservoir, and a closable intake aperture for supplying driving fluid from the reservoir to the driving chamber, the improvement comprising sliding valve means inserted in a passageway from the reservoir to the driving chamber intake, a restriction in the passageway from the pressure limiting valve to the reservoir, a branch passageway open to the passageway from the pressure limit valve to the reservoir upstream of the restriction, the branch passageway being in communication with a bore receiving the sliding valve whereby pressure in the branch passageway is effective to cause movement of the sliding valve to control driving fluid flow from the reservoir to the intake.

7. A device according to claim 6 wherein the sliding valve is a piston member reciprocal in a blind bore, the piston member having a first end projecting into the passageway from the reservoir to the intake aperture, the piston member having a cross-bore intermediate its ends, the cross-bore having ends open to a circumferential annular groove around the piston member, the circumferential annular groove being in communication with the branch passageway, the cross-bore communicating through a restriction to a chamber defined between a back wall of the blind bore and a second end of the piston member, and check valve means controlling discharge flow from the chamber to the branch passageway.

8. A device according to claim 7 wherein the check valve is interposed between the chamber and the cross-bore.

9. A device according to claim 8 wherein the second end of the piston member is of reduced diameter defining a circumferential reduction of a diameter of the piston member, the circumferential reduction adjacent and open to the chamber and spaced from the circumferential annular groove of the piston member.

* * * * *